US010800022B2

(12) United States Patent
Zhao et al.

(10) Patent No.: US 10,800,022 B2
(45) Date of Patent: Oct. 13, 2020

(54) POWERED-FASTENER-DRIVING TOOL INCLUDING A DRIVER BLADE HAVING A VARYING CROSS-SECTION

(71) Applicant: Illinois Tool Works Inc., Glenview, IL (US)

(72) Inventors: Hanxin Zhao, Northbrook, IL (US); Stephen Moore, Palatine, IL (US)

(73) Assignee: Illinois Tool Works Inc., Glenview, IL (US)

( * ) Notice: Subject to any disclaimer, the term of this patent is extended or adjusted under 35 U.S.C. 154(b) by 198 days.

(21) Appl. No.: 15/875,587

(22) Filed: Jan. 19, 2018

(65) Prior Publication Data

US 2018/0222030 A1 Aug. 9, 2018

Related U.S. Application Data

(60) Provisional application No. 62/456,954, filed on Feb. 9, 2017.

(51) Int. Cl.
*B25C 1/04* (2006.01)
*B25C 1/08* (2006.01)

(52) U.S. Cl.
CPC ..... *B25C 1/08* (2013.01); *B25C 1/047* (2013.01); *B25C 1/045* (2013.01)

(58) Field of Classification Search
CPC ..... B25C 1/047; B25C 1/04; B25C 1/08
USPC ..... 227/138, 130
See application file for complete search history.

(56) References Cited

U.S. PATENT DOCUMENTS 3,764,054 A * 10/1973 Monacelli ..... B25C 1/001 227/114
4,091,981 A * 5/1978 Moriguchi ..... B25C 1/001 227/130
4,483,473 A * 11/1984 Wagdy ..... F02P 11/04 123/46 SC
4,657,166 A * 4/1987 Anstett ..... B25C 1/044 227/130
4,763,562 A 8/1988 Haytayan
4,913,331 A 4/1990 Utsumi et al.
5,398,772 A * 3/1995 Edlund ..... B25D 9/14 173/206
6,318,239 B1 * 11/2001 Tsukada ..... B25C 1/047 173/210
7,021,516 B2 * 4/2006 Smolinski ..... B25C 1/047 227/130
7,040,521 B2 * 5/2006 Kolodziej ..... B25C 1/003 227/10
7,243,829 B2 * 7/2007 Oda ..... B25C 1/08 123/46 SC
7,290,691 B1 11/2007 Wen
(Continued)

FOREIGN PATENT DOCUMENTS

JP H09300238 11/1997
JP 2003117851 4/2003

OTHER PUBLICATIONS

International Search Report and Written Opinion for International Application No. PCT/US2018/014869, dated Jun. 11, 2018 (12 pages).

*Primary Examiner* — Gloria R Weeks
(74) *Attorney, Agent, or Firm* — Neal, Gerber & Eisenberg LLP

(57) ABSTRACT

Various embodiments of the present disclosure provide a powered-fastener-driving tool including driver blade that has a varying cross-section.

17 Claims, 12 Drawing Sheets

(56) References Cited

U.S. PATENT DOCUMENTS 7,293,684 B1 11/2007 Wen
7,306,047 B2 * 12/2007 Oda ..... B25D 9/04 173/135
7,708,177 B2 * 5/2010 Lee ..... B25C 1/143 123/46 SC
8,544,561 B2 * 10/2013 Aihara ..... B25C 1/047 173/162.1
8,925,780 B2 * 1/2015 Largo ..... B25C 1/005 227/2
8,939,340 B2 1/2015 Gardner et al.
9,707,673 B2 * 7/2017 Yang ..... B25C 7/00
9,782,878 B2 * 10/2017 Yang ..... B25C 7/00
9,796,072 B2 * 10/2017 Young ..... B25C 5/06
10,016,884 B2 * 7/2018 Wu ..... B25C 1/043
2005/0173140 A1 * 8/2005 Oda ..... B25D 16/00 173/78
2007/0131731 A1 * 6/2007 Moeller ..... B25C 1/08 227/10
2010/0065602 A1 * 3/2010 Zhao ..... B25C 1/08 227/9
2011/0000949 A1 * 1/2011 Ito ..... B25C 1/06 227/138
2012/0067935 A1 * 3/2012 Liu ..... B25C 1/047 227/10
2015/0102084 A1 4/2015 Zhao
2016/0151900 A1 * 6/2016 Wu ..... B25C 1/047 227/130
2017/0282341 A1 * 10/2017 Wolf ..... B25C 1/06
2018/0036870 A1 * 2/2018 Komazaki ..... B25C 1/047
2018/0050396 A1 * 2/2018 Lai ..... B23B 45/04
2018/0126527 A1 * 5/2018 Pomeroy ..... B25C 1/008
2018/0133877 A1 * 5/2018 Ueda ..... B25F 5/008
2018/0222028 A1 * 8/2018 Zhang ..... B25C 1/047
2019/0099872 A1 * 4/2019 Tanaka ..... B25C 1/184
2019/0111552 A1 * 4/2019 Nagao ..... B25C 1/008
2019/0126453 A1 * 5/2019 Po ..... B25C 1/041
2019/0168368 A1 * 6/2019 Fan ..... B25C 1/08
2019/0271337 A1 * 9/2019 Moodie ..... F15B 15/225
2020/0114500 A1 * 4/2020 Bierdeman ..... B25C 1/041

* cited by examiner

POWERED-FASTENER-DRIVING TOOL INCLUDING A DRIVER BLADE HAVING A VARYING CROSS-SECTION

PRIORITY

This application claims priority to and the benefit of U.S. Provisional Patent Application Ser. No. 62/456,954, filed Feb. 9, 2017, the entire contents of which are incorporated by reference herein.

BACKGROUND

The present disclosure relates to powered-fastener-driving tools. Generally, powered-fastener-driving tools use one of several types of power sources to carry out a fastener-driving cycle to drive a fastener (such as a nail or a staple) into a workpiece. More specifically, a powered-fastener-driving tool uses a power source to force a driving assembly, such as a piston carrying a driving element including a driver blade, through a cylinder from a pre-firing position to a firing position. As the driving assembly moves to the firing position, the driver blade travels through a nosepiece, which guides the driver blade to contact a fastener housed in the nosepiece. Continued movement of the driving assembly through the cylinder toward the firing position forces the driver blade to drive the fastener from the nosepiece into the workpiece. The driving assembly is then forced back to the pre-firing position in a way that depends on the tool's construction and power source. A fastener-advancing device forces another fastener from a magazine into the nosepiece, and the tool is ready to fire again.

Pneumatic-powered-fastener-driving tools use a compressed air power source. To operate a typical pneumatic-powered-fastener-driving tool, an operator depresses a workpiece-contact element of the tool onto a workpiece to move the workpiece-contact element from an extended position to a retracted position and then pulls the trigger to actuate a control valve and start the fastener-driving cycle. Actuation of the control valve causes compressed air to act on the top of the piston and force the driving assembly to move through the cylinder from the pre-firing position to the firing position, thereby causing the driver blade to contact a fastener housed in the nosepiece and drive the fastener from the nosepiece into the workpiece.

As the driving assembly moves toward the firing position, the piston drives air inside the cylinder through several vents defined in the cylinder into a return chamber, thereby increasing the air pressure in the return chamber. As the driving assembly reaches the firing position, the volume above the piston is exposed to atmosphere, and the compressed air stops acting on the top of the piston. After the driving assembly reaches the firing position, the air in the return chamber reenters the cylinder through the vents and pushes on the bottom of the piston to force the driving assembly back to its pre-firing position. The piston forces any air above it out of the tool to atmosphere while the driving assembly returns to the pre-firing position. This completes the fastener-driving cycle.

Combustion-powered-fastener-driving tools use a small internal combustion assembly as their power source. To operate a typical combustion-powered-fastener-driving tool, an operator depresses a workpiece-contact element of the tool onto a workpiece. This moves the workpiece-contact element from an extended position to a retracted position, which causes one or more mechanical linkages to cause: (1) a valve sleeve to move to a sealed position to seal a combustion chamber that is in fluid communication with the cylinder; and (2) a fuel delivery system to dispense fuel from a fuel canister into the (now sealed) combustion chamber.

The operator then pulls the trigger to actuate a trigger switch, thereby causing a spark plug to deliver a spark and ignite the fuel/air mixture in the combustion chamber and start the fastener-driving cycle. This generates high-pressure combustion gases that expand and act on the piston to force the driving assembly to move through the cylinder from the pre-firing position to the firing position, thereby causing the driver blade to contact a fastener housed in the nosepiece and drive the fastener from the nosepiece into the workpiece.

Just before the driving assembly reaches the firing position, the piston passes exhaust check valves defined through the cylinder, and some of the combustion gases that propel the cylinder exhaust through the check valves to atmosphere. This combined with heat exchange to the atmosphere and the fact that the combustion chamber remains sealed during the fastener-driving cycle generates a vacuum pressure above the piston, which causes the driving assembly to retract to the pre-firing position to complete the fastener-driving cycle. When the operator removes the workpiece-contact element from the workpiece, a spring biases the workpiece-contact element from the retracted position to the extended position, causing the one or more mechanical linkages to move the valve sleeve to an unsealed position to unseal the combustion chamber.

Some known or proposed combustion-powered-fastener-driving tools also include a return chamber similar to that of a pneumatic-powered-fastener-driving tool to help the piston return to the pre-firing position.

As explained below with respect to FIGS. 1A-1C, typical powered-fastener-driving tools that include a return chamber include a driver blade seal at the bottom of the cylinder. The driver blade seal operates with the driver blade to minimize air leakage through the nosepiece—and therefore maximize air flow into the return chamber—as the driving assembly moves from the pre-firing position to the firing position. The driver blade seal also operates with the driver blade to minimize air leakage through the nosepiece—and therefore maximize air pressure acting on the bottom of the piston—as the driving assembly moves from the firing position to the pre-firing position.

FIG. 1A shows an example prior art driving element 100 that includes: (1) an externally threaded connection element 102 threadably engageable to a piston (not shown); (2) a flange 104 attached to the bottom end of the connection element 102 and having an upper surface (not labeled) sized to engage an underside of the piston when the piston is threadably engaged to the connection element 102; and (3) a driver blade 106 attached to and extending from a lower surface (not labeled) of the flange 104 and terminating in a free end **106*a***.

The driver blade 106 has a longitudinal axis $A_{P4}$ and a length $L_{P4}$. Moving from the flange 104 to the free end **106*a* along the longitudinal axis $A_{P4}$, the driver blade: (1) tapers toward the longitudinal axis $A_{P4}$ to a width $W_{P41}$ along a distance $D_{P41}$; (2) maintains the width $W_{P41}$ along a distance $D_{P42}$; and (3) tapers toward the longitudinal axis $A_{P4}$ to a width $W_{P43}$ along a distance $D_{P43}$. Although not shown, the transverse cross-section of the driver blade 106 (taken along a horizontal plane perpendicular to the longitudinal axis $A_{P4}$) along the distance $D_{P42}$ is generally rectangular shaped, and its size and shape do not change. Put differently, the transverse cross-section of the driver blade 106** is generally uniform along the distance $D_{P42}$.

FIG. 1B shows an example prior at driver blade seal 190 that defines a driver blade receiving opening 190*a* therethrough. The driver blade receiving opening 190*a* is shaped to correspond to and is sized just larger than the transverse cross-section of the driver blade 106 along the distance $D_{PA2}$.

When installed, the driver blade 106 is slidably received in the driver blade receiving opening 190*a* of the driver blade seal 190. The driver blade 106 and the driver blade seal 190 are positioned such that some part of the driver blade 106 along the distance $D_{PA2}$ always occupies a portion of the driver blade receiving opening 190*a* when the driving assembly is in the firing position, the pre-firing position, or anywhere in between. Since the transverse cross-section of the driver blade 106 along the distance $D_{PA2}$ is uniform, the driver blade 106 always occupies the same portion of the driver blade receiving opening 190*a* regardless of the position of the piston 24.

FIG. 1C shows a transverse cross-section of the driver blade 106 just above the driver blade seal 190. The driver blade 106 does not entirely fill the driver blade receiving opening 190*a* and engage the driver blade seal 190. Rather, a small gap exists around the perimeter of the driver blade 106. This gap is large enough to prevent the driver blade 106 from frictionally engaging the driver blade seal 190 during the fastener-driving cycle, as too much friction between the driver blade and the driver blade seal could undesirably slow driving assembly movement during the fastener-driving cycle and negatively affect tool operation. Yet the gap is small enough to minimize air leakage, as too much air leakage through the driver blade seal could reduce the air pressure in the return chamber so much as to negatively affect the driving assembly's return to the pre-firing position, such as by preventing the driving assembly from returning to the pre-firing position or returning the driving assembly to the pre-firing position too slowly.

If the air pressure in the return chamber is excessively high when the driving assembly reaches the firing position, the piston will impact the top of the cylinder with excessive force when the driving assembly reaches the pre-firing position. This could damage the piston, the cylinder, or other tool components, especially with repeated use. Also, if the piston impacts the top of the cylinder with too much force, it could bounce off of the cylinder and cause the driving assembly to end up between the pre-firing and the firing position upon completion of the fastener-driving cycle. Improper positioning of the driving assembly could result in a misfire the next time the operator tries to drive a fastener.

There is a need for a powered-fastener-driving tool that solves these problems.

SUMMARY

Various embodiments of the present disclosure provide a powered-fastener-driving tool including driver blade that has a varying cross-section that solves the above problems.

In one embodiment, the powered-fastener-driving tool includes a cylinder, a return chamber in fluid communication with the cylinder, a driver blade seal that defines a driver blade receiving opening, a driving element including a driver blade, and a piston within and movable relative to the cylinder and the driver blade seal. The piston is attached to the driving element such that the driver blade is slidably received in the driver blade receiving opening. To drive a fastener, the piston is driven to move from a pre-firing position to a firing position. This movement forces air beneath the piston from the cylinder into the return chamber. Once the piston reaches the firing position and the air pressure in the return chamber has reached its maximum, the pressurized air flows from the return chamber back into the cylinder to force the piston from the firing position back to the pre-firing position.

The non-uniform cross-section of the driver blade is sized and shaped such that a portion of the driver blade receiving opening occupied by the driver blade changes as the piston moves between a pre-firing position and a firing position. This solves the above problems by reducing the impact force of the piston on the upper end of the cylinder when returning to the pre-firing position as compared to an identical prior art tool with a uniform cross-section driver blade. Specifically, since more air can leak through the driver blade receiving opening as the piston moves from the pre-firing position to the firing position, the return chamber is less pressurized following fastener driving than the return chamber of the prior art tool. This combined with the fact that more air can leak through the driver blade receiving opening as the piston moves from the firing position to the pre-firing position results in less force acting on the piston to return it to the pre-firing position as compared to the prior art tool. The varying cross-section of the driver blade thus precisely controls the amount of air leakage through the driver blade seal to achieve a desired piston return.

Other objects, features, and advantages of the present disclosure will be apparent from the detailed description and the drawings.

DETAILED DESCRIPTION

Various embodiments of the present disclosure provide a powered-fastener-driving tool including driver blade that has a varying cross-section. FIGS. 2 to 9B illustrate part of one example embodiment of a combustion-powered-fastener-driving tool 10 of the present disclosure (sometimes called the "tool 10" for brevity). Since certain portions of the tool 10—such as a tool housing, a workpiece contact element and associated linkage(s), a fuel canister and associated fuel delivery system, and a trigger and associated trigger switch—are well-known in the art, they are generally described below but are not shown for clarity.

Figure 4:
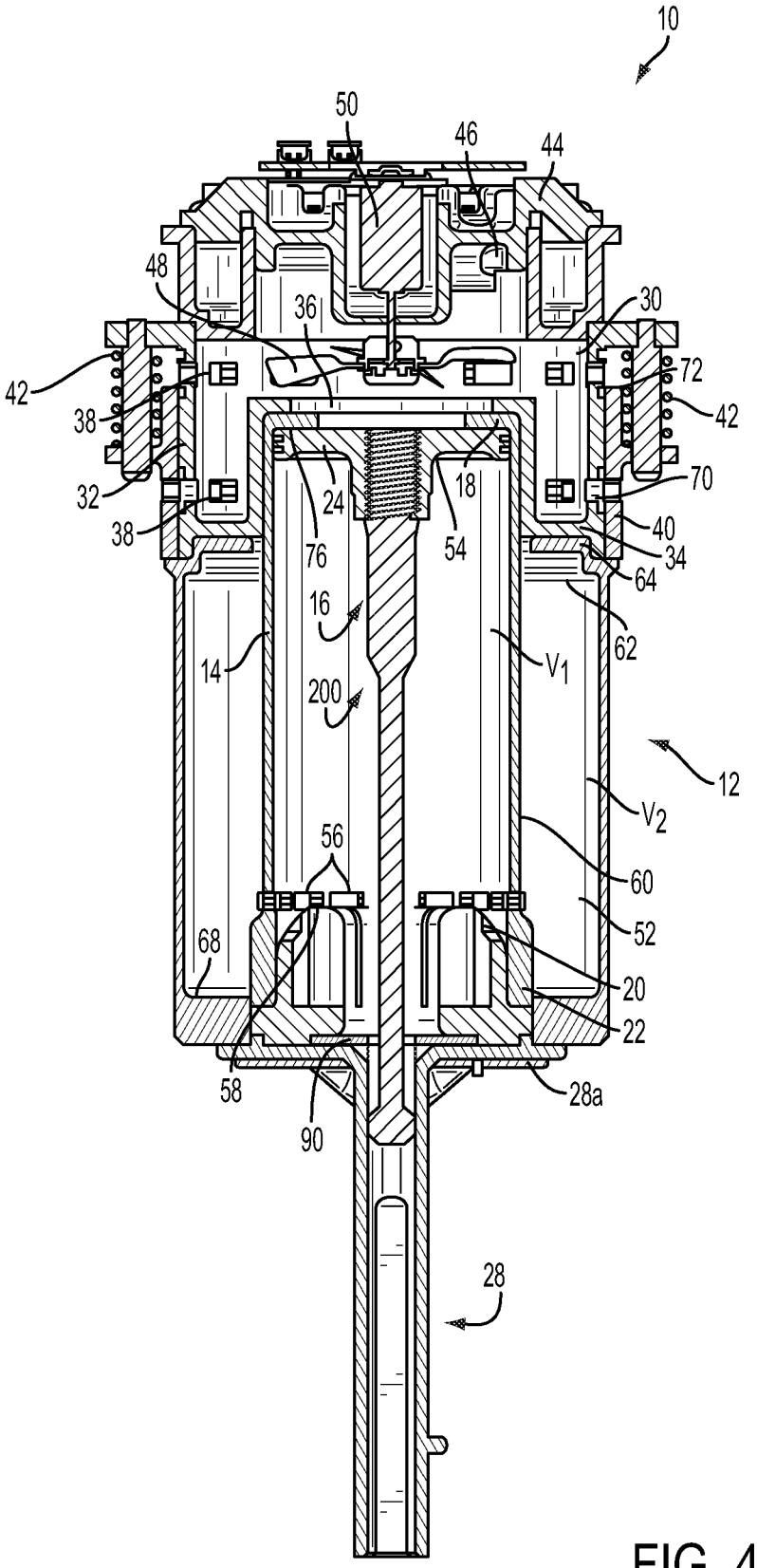
FIG. 4 is a fragmentary cross-sectional view of the tool of FIG. 2 taken substantially along the line 4-4 of FIG. 2.

As best shown in FIG. 4, the tool 10 generally includes: a cylinder 14 having an upper end 18 and a lower end 22; a driving assembly 16 slidably disposed within the cylinder 14; a bumper 20 at the bottom of the cylinder 14; a driver blade seal 90 below the bumper 20; a combustion chamber housing 30 partially surrounding and supported by the cylinder 14; a cylinder head 44 supported by the combustion chamber housing 30; a valve element 40 supported by, partially surrounding, and movable relative to the combustion chamber housing 30; a return chamber 52 partially surrounding the cylinder 14; and a nosepiece 28 depressible relative to the cylinder 14, connected to and extending from the bottom of the return chamber 52, sandwiching the bumper 20 between a nosepiece mounting plate 28*a* and the lower end 22 of the cylinder 14, and sandwiching the driver blade seal 90 between the nosepiece mounting plate 28*a* and the bumper 20.

One or more, and in this illustrated embodiment multiple, circumferentially spaced return ports 56 are defined through the cylinder 14 near an upper edge 58 of the bumper 20. The quantity and location of the return ports 56 may vary. The portion of this example cylinder 14 that extends between the upper end 18 and the return ports 56 does not define any openings therethrough. But in other embodiments, the portion of the cylinder that extends between the upper end and the return ports defines one or more openings therethrough.

The driving assembly 16 includes a piston 24 threadably engaged to a driving element 200. The piston 24 has an upper surface 76, an underside 54, and an outer cylindrical surface (not labeled). A sealing element (such as an o-ring) is attached to the outer surface and sealingly engages the inner cylindrical surface of the cylinder 14 to prevent the volume of the cylinder 14 below the piston 24 from fluidly communicating with the volume of the cylinder 14 above the piston 24.

Figure 3:
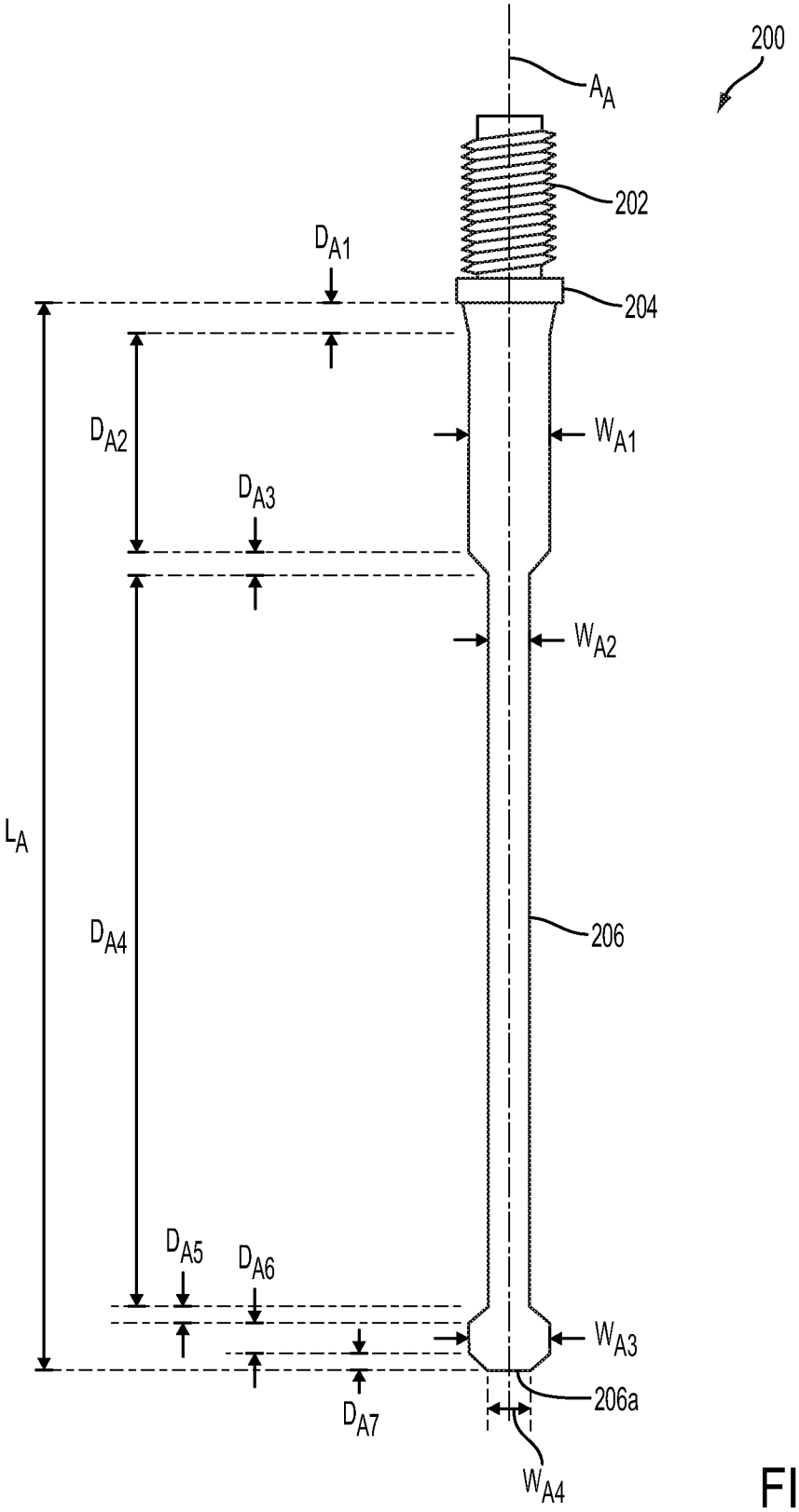
FIG. 3 is a front elevational view of the driving element of the tool of FIG. 1.

As best shown in FIG. 3, the driving element 200 includes: (1) an externally threaded connection element 202 threadably engageable to the piston 24 (though the piston and driving element may be connectable in any other suitable manner); (2) a flange 204 attached to the bottom end of the connection element 202 and having an upper surface (not labeled) sized to engage the underside 54 of the piston 24 when the piston 24 is threadably engaged to the connection element 202; and (3) a driver blade 206 attached to and extending from a lower surface (not labeled) of the flange 204 and terminating in a free end 206*a*.

The driver blade 206 has a longitudinal axis $A_A$ and a length $L_A$. Moving from the flange 204 to the free end 206*a* along the longitudinal axis $A_A$, the driver blade 206: (1) tapers toward the longitudinal axis $A_A$ to a width $W_{A1}$ along a distance $D_{A1}$; (2) maintains the width $W_{A1}$ along a distance $D_{A2}$; (3) tapers toward the longitudinal axis $A_A$ to a width $W_{A2}$ along a distance $D_{A3}$; (4) maintains the width $W_{A2}$ along a distance $D_{A4}$; (5) tapers away from the longitudinal axis $A_A$ to a width $W_{A3}$ along a distance $D_{A5}$; (6) maintains the width $W_{A3}$ along a distance $D_{A6}$; and (7) tapers toward the longitudinal axis $A_A$ to a width $W_{A4}$ along a distance $D_{A7}$.

Although not shown, the transverse cross-section of the driver blade 206 (taken along a horizontal plane perpendicular to the longitudinal axis $A_A$): (1) along the distance $D_{A2}$ is generally rectangular shaped, and its size and shape do not change; (2) along the distance $D_{A4}$ is generally rectangular shaped, and its size and shape do not change; and (3) along the distance $D_{A6}$ is generally rectangular shaped, and its size and shape do not change. Put differently, the transverse cross-section of the driver blade 206 is generally uniform along the distance $D_{A2}$, along the distance $D_{A4}$, and along the distance $D_{A6}$. The transverse cross-section of the driver blade 206 along the distance $D_{A2}$ and the transverse cross-section of the driver blade 206 along the distance $D_{A4}$ are different. The transverse cross-section of the driver blade 206 along the distance $D_{A4}$ and the transverse cross-section of the driver blade 206 along the distance $D_{A6}$ are different. The transverse cross-section of the driver blade 206 along the distance $D_{A2}$ and the transverse cross-section of the driver blade 206 along the distance $D_{A6}$ may be the same or different.

Figure 6B:
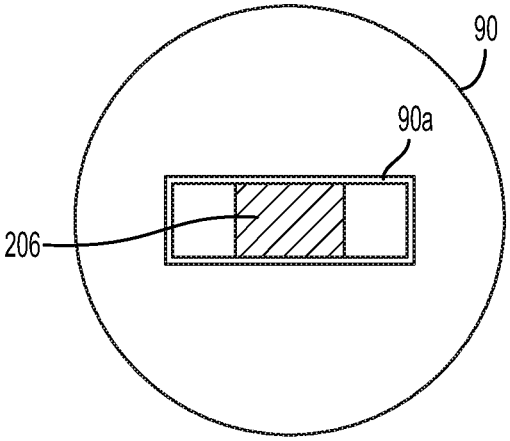
FIG. 6B is a fragmentary cross-sectional view of the tool of FIG. 2 taken substantially along the line 6B-6B of FIG. 6A.
Figure 7A:
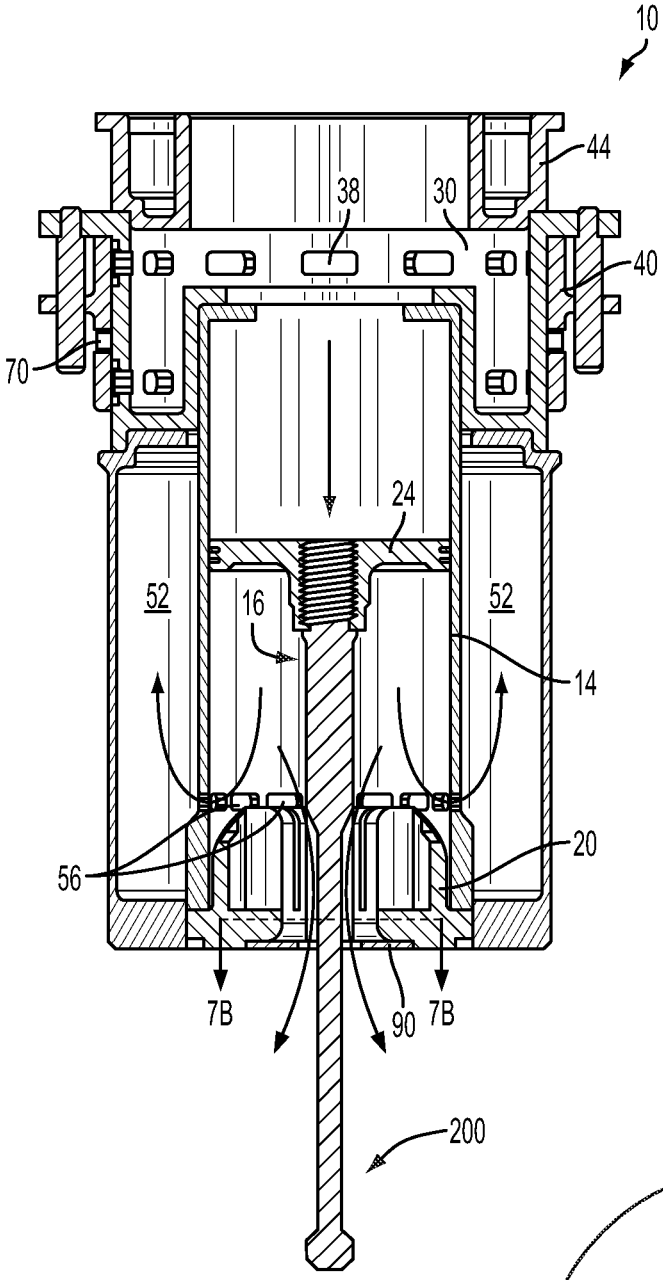
FIG. 7A is a fragmentary cross-sectional view, taken substantially along the line 4-4 of FIG. 2, of the tool of FIG. 2 after the piston has begun moving from the pre-firing position to the firing position.
Figure 7B:
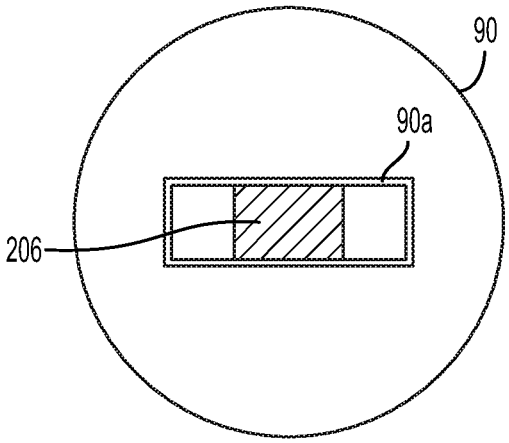
FIG. 7B is a fragmentary cross-sectional view of the tool of FIG. 2 taken substantially along the line 7B-7B of FIG. 7A.
Figure 8A:
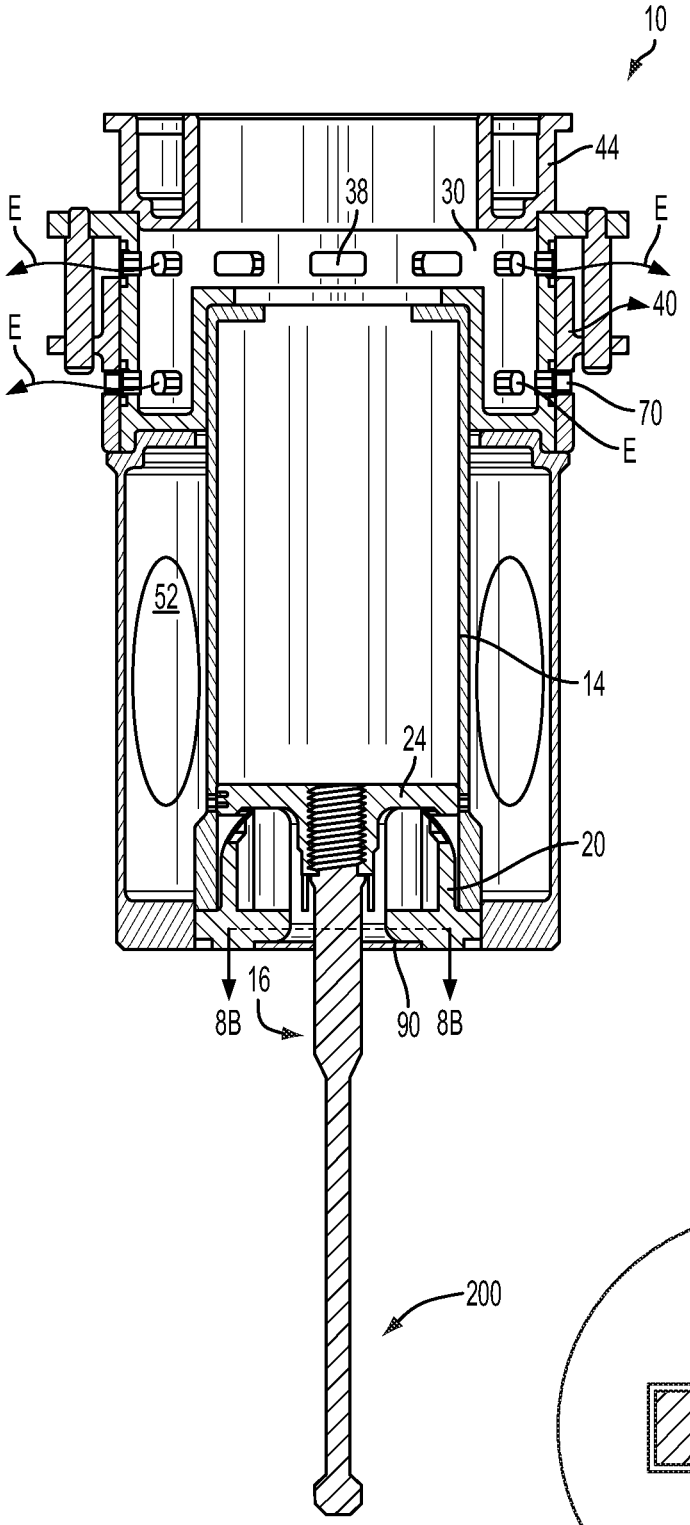
FIG. 8A is a fragmentary cross-sectional view, taken substantially along the line 4-4 of FIG. 2, of the tool of FIG. 2 with the driving assembly in the firing position.
Figure 8B:
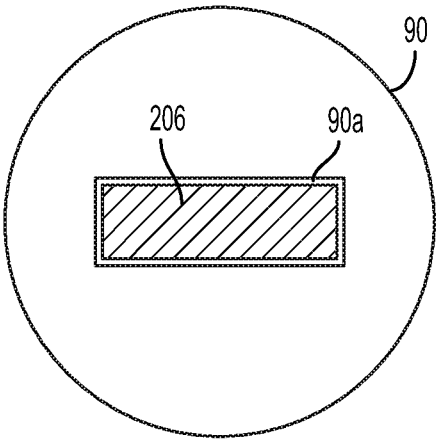
FIG. 8B is a fragmentary cross-sectional view of the tool of FIG. 2 taken substantially along the line 8B-8B of FIG. 8A.

FIGS. 5B, 6B, 7B, 8B, and 9B best show the driver blade seal 90, which defines a driver blade receiving opening 90*a* therethrough. The driver blade receiving opening 90*a* is shaped to correspond to and is sized just larger than the transverse cross-section of the driver blade 106 along the distance $D_{A2}$, as shown in FIG. 8B.

The driving assembly 16 is movable within and relative to the cylinder 14 between a pre-firing position (FIGS. 4, 5A, and 6A) and a firing position (FIG. 8A). When the driving assembly 16 is in the pre-firing position, part of the top surface 76 of the piston 24 engages the underside of the upper end 18 of the cylinder 14. When the driving assembly 16 is in the firing position, part of the underside 54 of the piston 24 contacts the upper edge 58 of the bumper 20.

When installed, the driver blade 206 is slidably received in the driver blade receiving opening 90*a* of the driver blade seal 90. The driver blade 206 and the driver blade seal 90 are positioned such that: (1) when the driving assembly 16 is in the pre-firing position (FIGS. 4, 5A, and 6A), part of the driver blade 206 along the distance $D_{A4}$ occupies a first portion of the driver blade receiving opening 90*a*; (2) when the driving assembly 16 is in the firing position (FIG. 8A), part of the driver blade 206 along the distance $D_{A2}$ occupies a second larger portion of the driver blade receiving opening 90*a*; and (3) when the driving assembly 16 is in between the pre-firing and firing positions, the position of the driving assembly 16 controls which part of the driver blade 206 along the distance $D_{A2}$, $D_{A3}$, or $D_{A4}$ occupies the driver blade receiving opening 90*a* and how much of the driver blade receiving opening 90*a* is occupied.

Since the transverse cross-section of the driver blade 206 differs along the distances $D_{A2}$, $D_{A3}$, and $D_{A4}$, the driver blade 206 occupies different portions of the driver blade receiving opening 90*a* (depending on the position of the driving assembly 16) throughout the fastener-driving cycle. Put differently, the unoccupied portion of the driver blade receiving opening 90*a* varies throughout the fastener-driving cycle. This means that the amount of air that can escape the cylinder 14 during the fastener-driving cycle through the portion of the driver blade receiving opening 90*a* unoccupied by the driver blade 206 changes as the driving assembly 16 moves, as described below with respect to FIGS. 5B, 6B, 7B, 8B, and 9B.

The following components of the tool 10 collectively define a combustion chamber: the cylinder head 44, the combustion chamber housing 30 that includes a generally cylindrical outer wall 32 and a floor 34, and the upper surface 76 of the piston 24 (when the driving assembly 16 is in the pre-firing position). This is merely one example combustion chamber, and in other embodiments the combustion chamber may be differently shaped and/or sized and may be defined by any suitable components.

The combustion chamber is in fluid communication with the cylinder 14 via an opening 36 defined through the combustion chamber housing 30 and an opening defined in the upper end 18 of the cylinder 14. Unlike in conventional combustion-powered-fastener-driving tools, the outer wall 32 of the combustion chamber housing 30 is fixed relative to the cylinder 14 during the entire fastener-driving cycle.

Figure 1A:
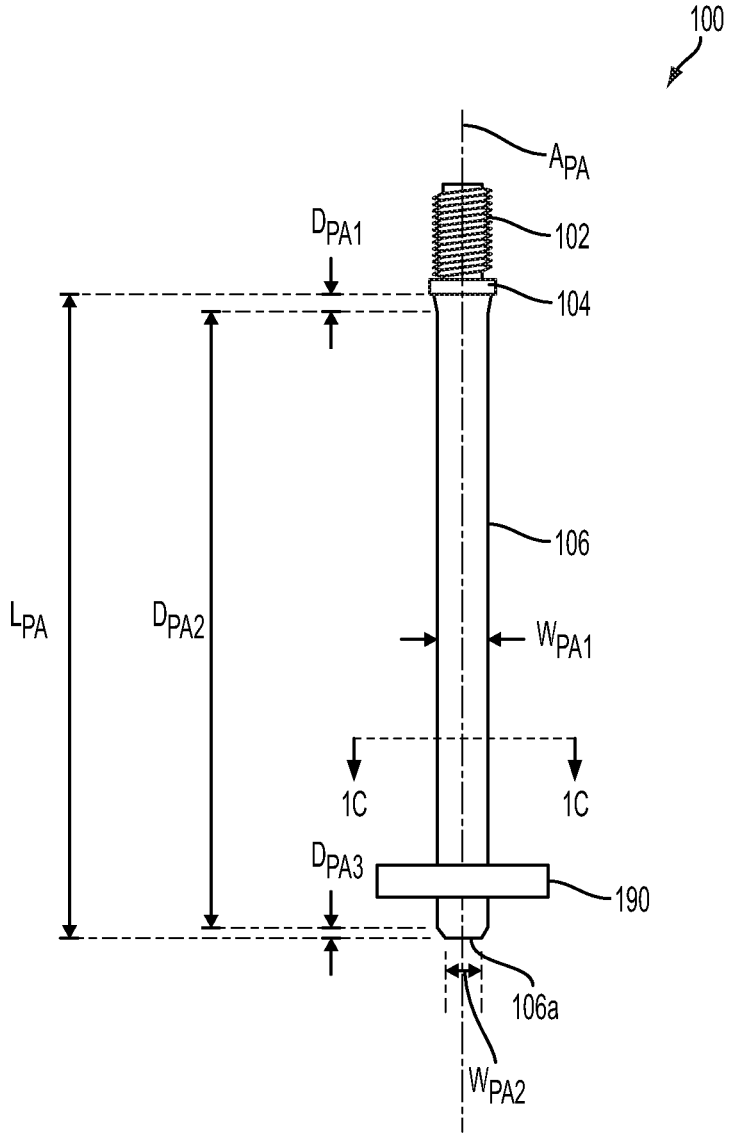
FIG. 1A is a front elevational view of a prior art driving element and a prior art driver blade seal.
Figure 1B:
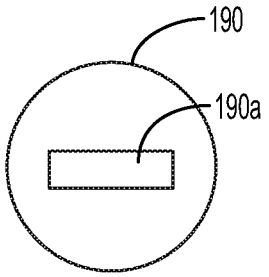
FIG. 1B is a top plan view of the driver blade seal of FIG. 1A.
Figure 1C:
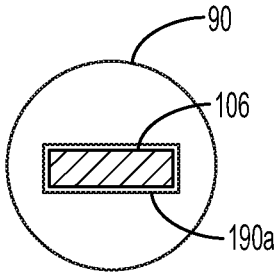
FIG. 1C is a top plan cross-sectional view of the driver blade of the driving element of FIG. 1A received in the driver blade seal of FIG. 1A taken substantially along the line 1C-1C of FIG. 1A.
Figure 2:
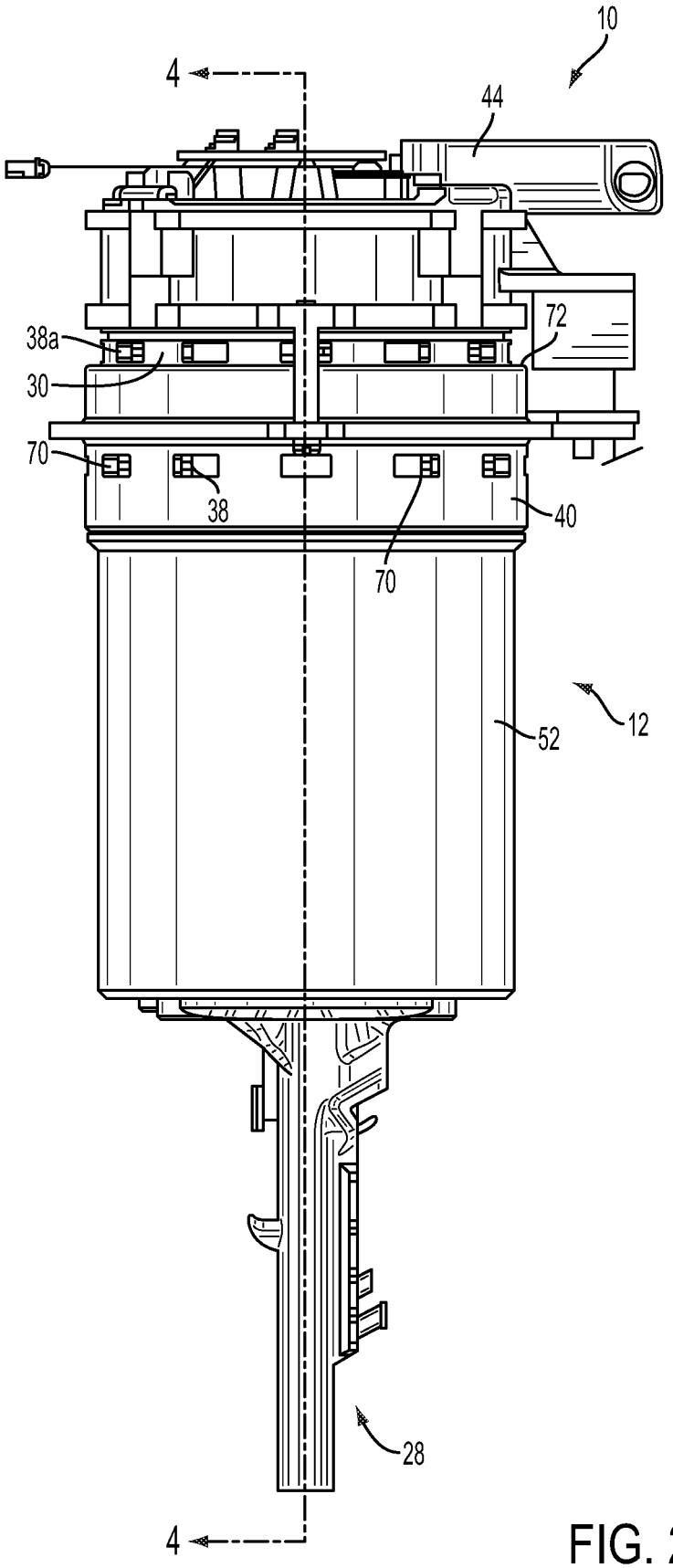
FIG. 2 is a fragmentary front elevational view of one example embodiment of the combustion-powered-fastener-driving tool of the present disclosure.

As best shown in FIGS. 2 and 4, the valve element 40, which defines multiple ports 70 therethrough, is supported by and partially surrounds the outer wall 32 of the combustion chamber housing 30. The valve element 40 is movable relative to the outer wall 32 between: (1) an open position in which the ports 70 at least partially align with ports 38 defined through the outer wall 32; and (2) a closed position in which the ports 70 are not aligned with and block the ports 38, thereby sealing the combustion chamber. As best shown in FIG. 2, at least some of the ports 38*a* of the outer wall 32 are located above an upper edge 72 of the valve element 40 and fluidically connect the combustion chamber to atmosphere outside of the tool 10 when the valve element 40 is in the open position. In various embodiments, the same ports 38 are used to intake air pre-ignition and to exhaust combustion gases post-ignition, as described further below.

One or more, and in this embodiment multiple, biasing elements 42 (such as springs) bias the valve element 40 to the open position. In this embodiment, to move the valve element 40 to the closed position, an operator depresses the nosepiece 28 of the tool 10—and more particularly a workpiece contact element (not shown) at the end of the nosepiece 28 as is known in the art—against a workpiece with enough force to cause a linkage (not shown) that connects the nosepiece 28 to the valve element 40 to impose a force on the valve element 40 that overcomes the collective biasing force of the biasing elements 42. This causes the valve 40 to move relative to the outer wall 32 and toward the cylinder head 44 to the closed position, thereby sealing the combustion chamber by blocking the ports 38.

Although not shown, as is known in the art, depressing the nosepiece 28 of the tool against the workpiece also causes, such as via actuation of one or more mechanical or electromechanical switches: (1) a fuel canister (not shown) to dispense fuel into the combustion chamber via a fuel delivery system (not shown); and (2) a motor 50 attached to the cylinder head 44 to drive a fan blade 48 at least partially disposed within the combustion chamber for a designated period of time that spans the fastener-driving cycle and enables enhanced mixing of air and fuel within the combustion chamber before ignition and also facilitates exchanging combustion gases for fresh air after ignition.

As best shown in FIG. 4, the return chamber 52 is in fluid communication with the cylinder 14 via the return ports 56. The return chamber 52 is also in fluid communication with the atmosphere surrounding the tool 10 via the return ports 56, the unoccupied portion of the driver blade receiving opening 90*a* of the driver blade seal 90, and the nosepiece 28. The return chamber 52 surrounds an exterior wall 60 of the cylinder 14, and at an upper end 62 is defined in part by a radially inwardly projecting annular flange 64 with a seal 66 engaging the exterior wall 60. Opposite the flange 64, a lower return chamber end 68 is closed off. While the return chamber at least partially surrounds the cylinder in this illustrated embodiment, in other embodiments the return chamber may be shaped and/or located differently, such as within a handle of the tool 10.

In operation, after ignition of the fuel/air mixture in the combustion chamber and movement of the driving assembly 16 to the firing position, the driving assembly 16 returns to the pre-firing position through action of pressurized air stored in the return chamber 52 simultaneously with exhaustion of the combustion gases from the combustion chamber. Specifically, as the driving assembly 16 moves relative to the cylinder 14 from the pre-firing position to the firing position under the force generated by ignition of the fuel/air mixture in the combustion chamber, the piston 24 compresses and forces the air below the underside 54 of the piston 24 through the return ports 56 and into the return chamber 52.

Once the driving assembly 16 reaches the firing position, recoil forces created by the action of driving a fastener cause the nosepiece 28 of the tool 10, which an operator is holding, to disengage the workpiece. This movement removes the forces opposing the collective biasing force of the biasing elements 42, which causes the biasing elements 42 to move the valve element 40 to the open position. This unseals the combustion chamber and fluidically connects it to atmosphere outside tool 10 (via the ports 38 and 70), enabling the combustion gases to exhaust from the combustion chamber and fresh air to enter the combustion chamber. This is contrary to conventional combustion-powered-fastener-driving tools in which the combustion chamber must remain closed until the piston returns to the pre-firing position to ensure that the differential pressure required to return the piston to the pre-firing position is maintained.

After the driving assembly 16 reaches the firing position and contacts the bumper 20, the air pressure in the return chamber 52 is greater than the air pressure in the cylinder 14. This causes the pressurized air in the return chamber 52 to flow back through the return ports 56 into the cylinder 14. Some of that air acts on the underside 54 of the piston 24 to force the driving assembly 16 back to the pre-firing position while the remainder escapes through the unoccupied portion of the driver blade receiving opening 90*a* to atmosphere.

FIGS. 5A-9B show the tool 10 at different stages of the fastener-driving cycle. For the purposes of this example embodiment, the fastener-driving cycle starts following: (1)

depression of the nosepiece 28 against a workpiece to move the valve element 40 to the closed position (thereby sealing the combustion chamber) and cause the fuel canister to dispense fuel into the combustion chamber; and (2) actuation of a trigger switch (not shown) via an operator pulling a trigger (not shown) as known in the art to cause a spark generator 46 attached to the cylinder head 44 to ignite the fuel/air mixture in the combustion chamber. This causes the driving assembly to travel from the pre-firing position to the firing position, thereby causing the driver blade 26 to drive a fastener from the nosepiece 28 into the workpiece. The fastener-driving cycle ends when the driving assembly 16 returns to the pre-firing position.

Figure 5A:
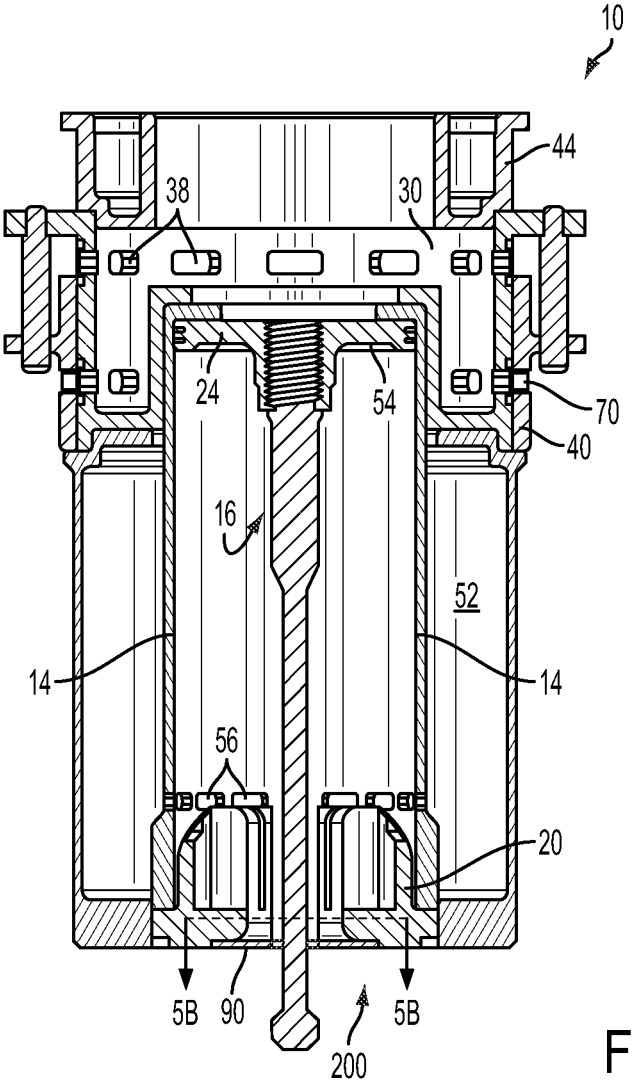
FIG. 5A is a fragmentary cross-sectional view, taken substantially along the line 4-4 of FIG. 2, of the tool of FIG. 2 pre-ignition.
Figure 5B:
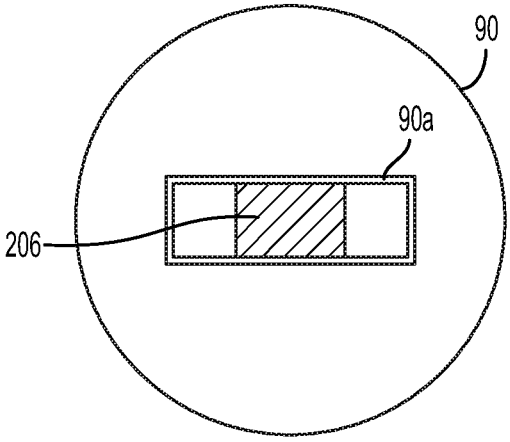
FIG. 5B is a fragmentary cross-sectional view of the tool of FIG. 2 taken substantially along the line 5B-5B of FIG. 5A.

FIG. 5A shows the tool 10 before the nosepiece 28 (not shown) has been depressed against the workpiece (not shown). The valve element 40 is in the open position, the combustion chamber is unsealed, and the driving assembly 16 is in the pre-firing position. As shown in FIG. 5B, part of the driver blade 206 along the distance $D_{A4}$ occupies a first portion of the driver blade receiving opening 90*a* of the driver blade seal 90.

Figure 6A:
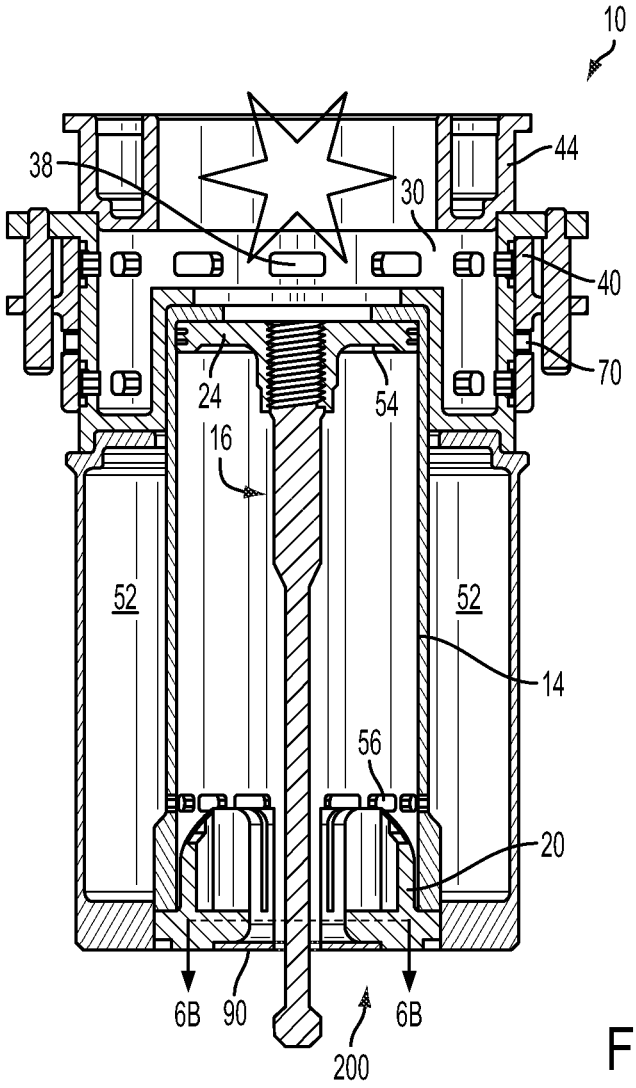
FIG. 6A is a fragmentary cross-sectional view, taken substantially along the line 4-4 of FIG. 2, of the tool of FIG. 2 immediately post-ignition.

FIG. 6A shows the tool 10 after: (1) the nosepiece 28 has been pressed against the workpiece to move the valve element 40 to the closed position and seal the combustion chamber while also causing the fuel canister to dispense fuel into the combustion chamber; and (2) the operator pulled the trigger to actuate the trigger switch and cause the spark generator 46 to ignite the fuel/air mixture inside the combustion chamber. As shown in FIG. 6B, the same part of the driver blade 206 along the distance $D_{A4}$ occupies the first portion of the driver blade receiving opening 90*a* of the driver blade seal 90.

FIG. 7A shows the tool 10 after the combustion gases have forced the driving assembly 16 to begin moving from the pre-firing position to the firing position. The valve element 40 remains in the closed position and the combustion chamber remains sealed (with the valve element 40 blocking the ports 38). As the driving assembly 16 travels toward the firing position, the piston 24 forces the air beneath it to flow: (1) through the return ports 56 into the return chamber 52; and (2) through the part of the driver blade opening not occupied by the driver blade 206. As shown in FIG. 7B, part of the driver blade 206 along the distance $D_{A4}$ occupies the first portion of the driver blade receiving opening 90*a* of the driver blade seal 90.

FIG. 8A shows the tool 10 as the driving assembly 16 reaches the firing position and after the driver blade 26 has driven a fastener (not shown) housed in the nosepiece 28. The combustion chamber is unsealed by return of the valve element 40 to the open position through tool recoil (i.e., the nosepiece 28 disengaging the workpiece). Exhaust E flows through the openings 38 and 70 to atmosphere outside of the tool 10. This relatively rapid exhaust of combustion gases significantly reduces heat buildup in the tool 10. At this point, the air in the return chamber 52 has reached its maximum pressure during the fastener-driving cycle. As shown in FIG. 8B, part of the driver blade 206 along the distance $D_{A2}$ now occupies a second portion of the driver blade receiving opening 90*a* of the driver blade seal 90. The second portion of the driver blade receiving opening 90*a* is larger than the first portion of the driver blade receiving opening 90*a*. Specifically, in this illustrated example, the ratio of the first portion to the second portion is about 0.250:0.425. In various embodiments, the first portion is about 35% to 40% smaller than the second portion.

So as the driving assembly 16 moves from the pre-firing position to the firing position, the driver blade 206 switches from occupying the first, smaller portion of the driver blade receiving opening 90*a* along the distance $D_{A2}$ to the second, larger portion of the driver blade receiving opening 90*a* along the distance $D_{A4}$. Since the first portion is smaller than the second portion, more air escapes to atmosphere through the unoccupied portion of the driver blade receiving opening 90*a* when the driver blade 206 occupies the first portion of the driver blade receiving opening 90*a* than when the driver blade 206 occupies the second portion of the driver blade receiving opening 90*a*.

Additionally, the varying cross-section of the driver blade 206 results in a lower maximum air pressure in the return chamber 52 as compared to a driver blade with a uniform cross-section identical to the cross-section along $D_{A2}$. Since the portion of the driver blade 206 along the distance $D_{A4}$ occupies less of the driver blade receiving opening 90*a* as compared to the cross-section along $D_{A2}$, it enables comparatively more air to escape through the (larger) unoccupied portion of the driver blade receiving opening 90*a* to atmosphere and comparatively less air to enter the return chamber 52.

Figure 9A:
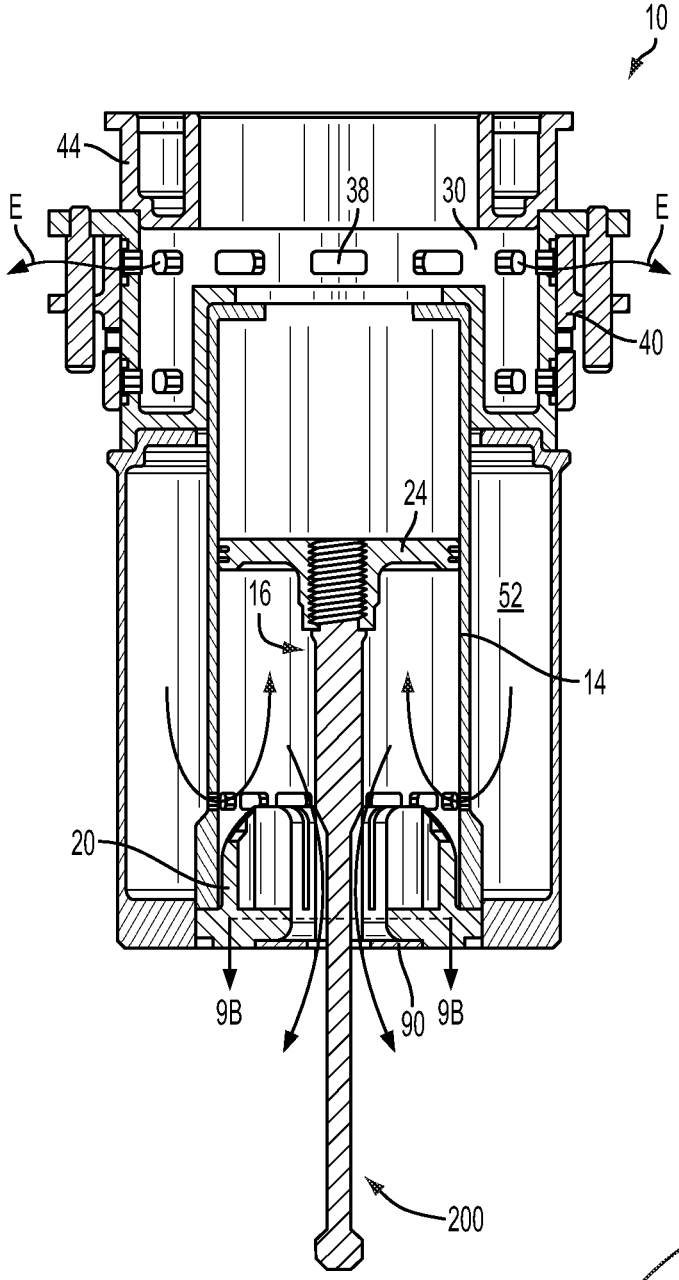
FIG. 9A is a fragmentary cross-sectional view, taken substantially along the line 4-4 of FIG. 2, of the tool of FIG. 2 after the piston has begun moving from the firing position back to the pre-firing position.
Figure 9B:
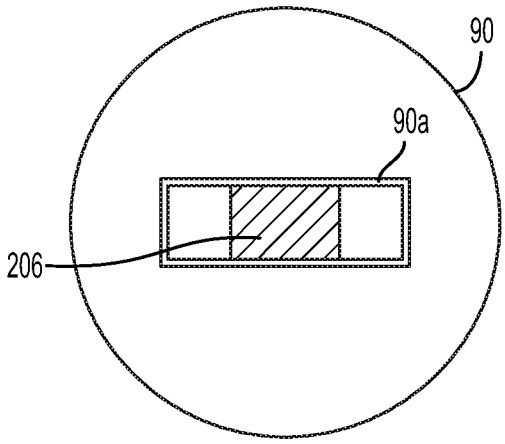
FIG. 9B is a fragmentary cross-sectional view of the tool of FIG. 2 taken substantially along the line 9B-9B of FIG. 9A.

FIG. 9A shows the tool 10 after the air stored in the return chamber 52 has acted on the piston 24 and begun forcing it from the firing position back toward the pre-firing position. As shown in FIG. 9B, part of the driver blade 206 along the distance $D_{A4}$ now occupies the first portion of the driver blade receiving opening 90*a* of the driver blade seal 90. Following piston return, the tool 10 resumes the position shown in FIG. 5A.

So as the driving assembly 16 moves from the firing position to the pre-firing position, the driver blade 206 switches from occupying the second, larger portion of the driver blade receiving opening 90*a* along the distance $D_{A2}$ to the first, smaller portion of the driver blade receiving opening 90*a* along the distance $D_{A4}$. Since the second portion is larger than the first portion, less air escapes to atmosphere through the unoccupied portion of the driver blade receiving opening 90*a* when the driver blade 206 occupies the second portion of the driver blade receiving opening 90*a* than when the driver blade 206 occupies the first portion of the driver blade receiving opening 90*a*. This means that the air entering the cylinder 14 from the return chamber 52 applies comparatively more force on the underside 54 of the piston 24 when the driver blade 206 occupies the second portion of the driver blade receiving opening 90*a* than when the driver blade 206 occupies the first portion of the driver blade receiving opening 90*a*.

Additionally, the varying cross-section of the driver blade 206 results in a reduced impact force of the piston 24 on the upper end 18 of the cylinder 14 upon return to the pre-firing position as compared to a driver blade with a uniform cross-section identical to the cross-section along $D_{A2}$. Since the portion of the driver blade 206 along the distance $D_{A4}$ occupies less of the driver blade receiving opening 90*a* as compared to the cross-section along $D_{A2}$, more air to escape through the (larger) unoccupied portion of the driver blade receiving opening 90*a* to atmosphere and there is less air pressure forcing the piston 24 to the pre-firing position. The varying cross-section of the driver blade thus precisely controls the amount of air leakage through the driver blade seal to achieve a desired piston return.

In one example embodiment: $W_{A1}$ and $W_{A3}$ are 0.425 inches, $W_{A2}$ is 0.250 inches, $W_{A4}$ is 0.375 inches, $D_{A1}$ is 0.125 inches; $D_{A2}$ is 2.45 inches; $D_{A3}$ and $D_{A5}$ are 0.100 inches, $D_{A4}$ is 2.6 inches, $D_{A6}$ is 0.080 inches, $D_{A7}$ is 0.140 inches, the thickness of the driver blade 206 along its length $L_A$ is 0.105 inches. In one example embodiment, the cylinder volume is about 16 cubic inches and the return chamber volume is about 32 cubic inches, though these may vary in other embodiments.

Figure 10:
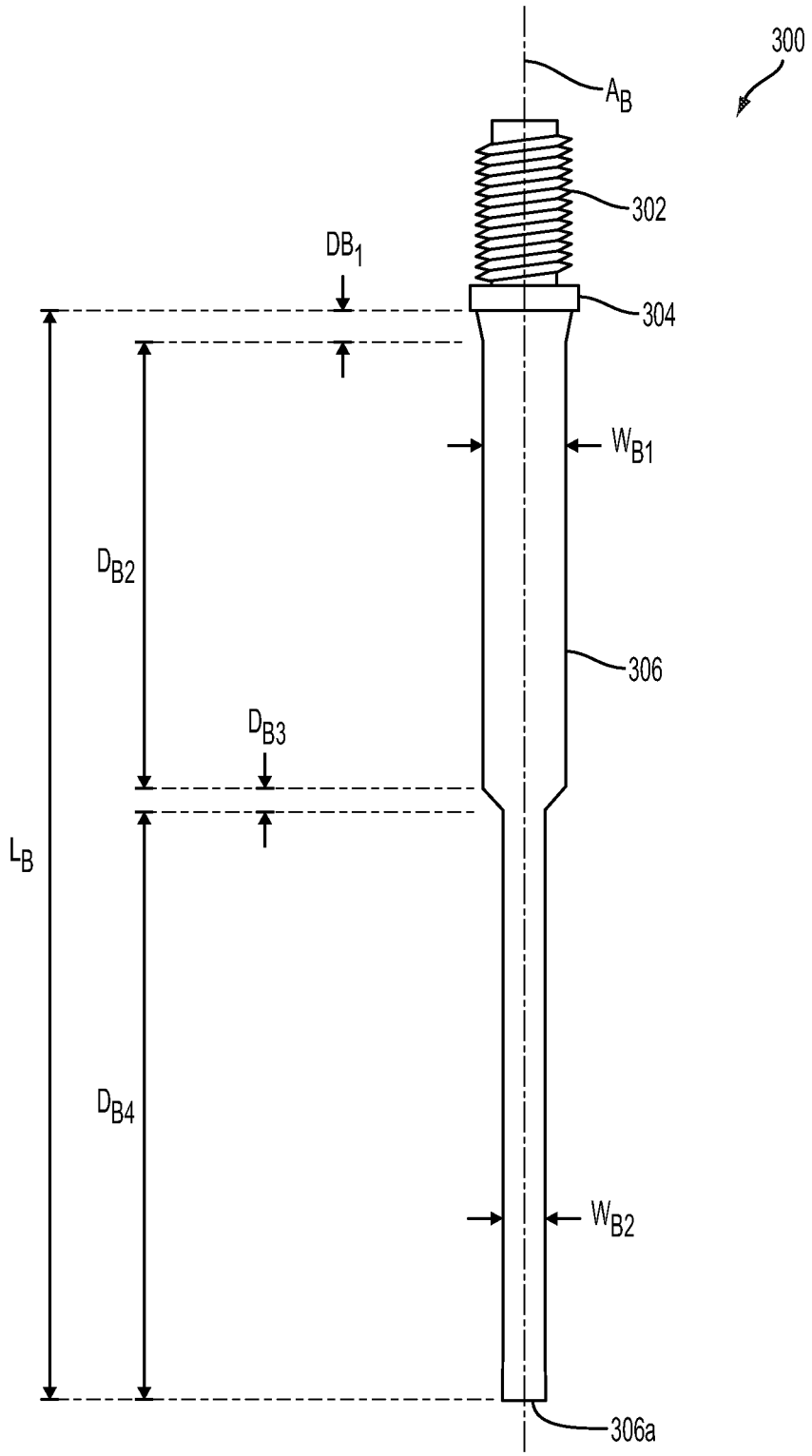
FIG. 10 is a front elevational view of another driving element with a varying cross-section.

FIG. 10 shows another example driving element 300, which includes: (1) an externally threaded connection element 302 threadably engageable to the piston 24; (2) a flange 304 attached to the bottom end of the connection element 302 and having an upper surface (not labeled) sized to engage the underside of the piston when the piston is threadably engaged to the connection element 302; and (3) a driver blade 306 attached to and extending from a lower surface (not labeled) of the flange 304 and terminating in a free end 306*a*.

The driver blade 306 has a longitudinal axis $A_B$ and a length $L_B$. Moving from the flange 304 to the free end 306*a* along the longitudinal axis $A_B$, the driver blade 306: (1) tapers toward the longitudinal axis $A_B$ to a width $W_{B1}$ along a distance $D_{B1}$; (2) maintains the width $W_{B1}$ along a distance $D_{B2}$; (3) tapers toward the longitudinal axis $A_B$ to a width $W_{B2}$ along a distance $D_{B3}$; and (4) maintains the width $W_{B2}$ along a distance $D_{B4}$.

Although not shown, the transverse cross-section of the driver blade 306 (taken along a horizontal plane perpendicular to the longitudinal axis $A_B$): (1) along the distance $D_{B2}$ is generally rectangular shaped, and its size and shape do not change; and (2) along the distance $D_{B4}$ is generally rectangular shaped, and its size and shape do not change. Put differently, the transverse cross-section of the driver blade 306 is generally uniform along the distance $D_{B2}$ and along the distance $D_{B4}$. The transverse cross-section of the driver blade 306 along the distance $D_{B2}$ and the transverse cross-section of the driver blade 306 along the distance $D_{B4}$ are different.

Since $D_{B2}$ is larger than $D_{A2}$, assuming all other factors are held constant, the pressure in the return chamber would be higher for the driving element 300 than for the driving element 200.

Figure 11:
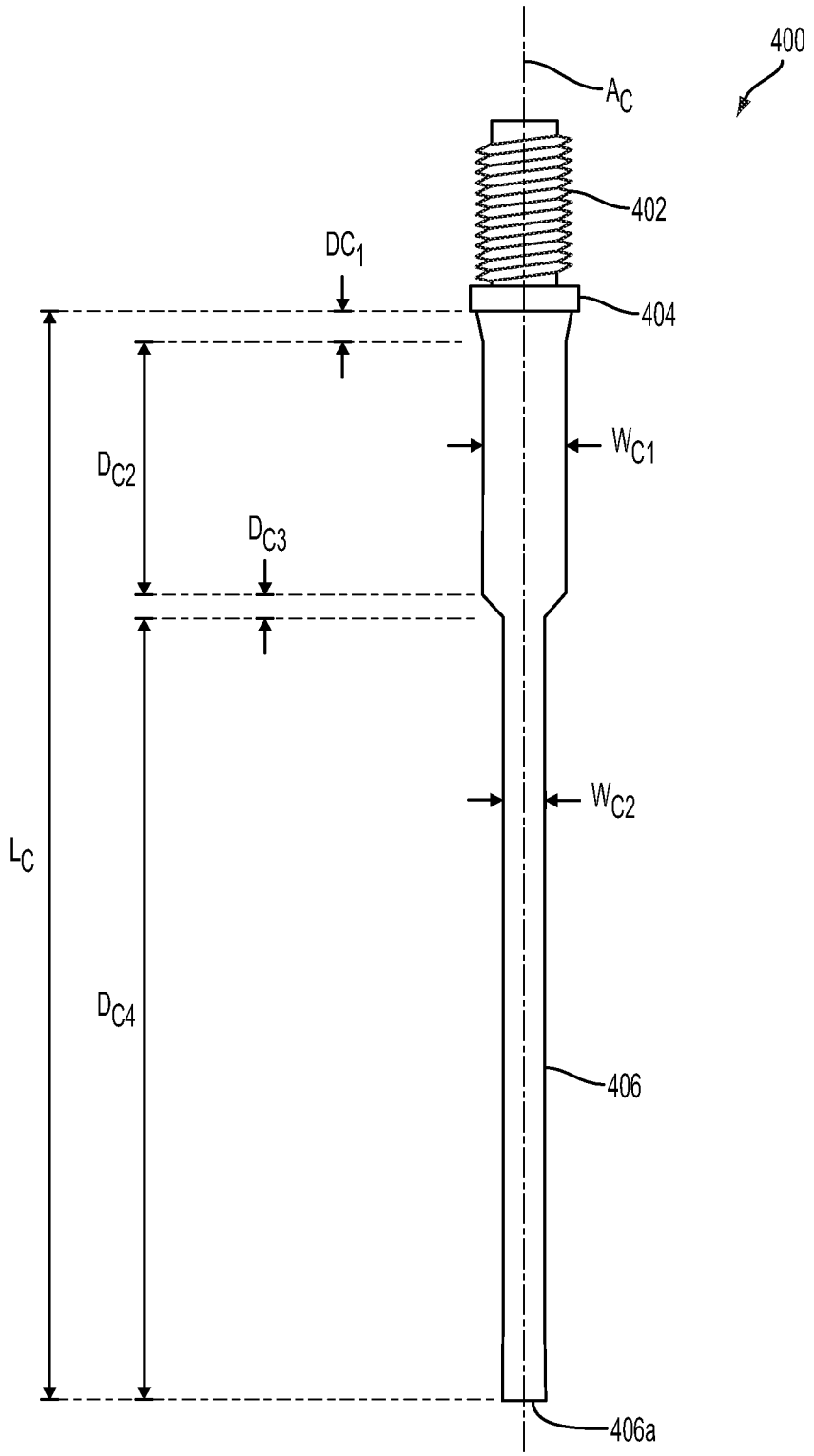
FIG. 11 is a front elevational view of another driving element with a varying cross-section.

FIG. 11 shows another example driving element 400, which includes: (1) an externally threaded connection element 402 threadably engageable to the piston 24; (2) a flange 404 attached to the bottom end of the connection element 402 and having an upper surface (not labeled) sized to engage the underside of the piston when the piston is threadably engaged to the connection element 402; and (3) a driver blade 406 attached to and extending from a lower surface (not labeled) of the flange 404 and terminating in a free end 406*a*.

The driver blade 406 has a longitudinal axis $A_C$ and a length $L_C$. Moving from the flange 404 to the free end 406*a* along the longitudinal axis $A_C$, the driver blade 406: (1) tapers toward the longitudinal axis $A_C$ to a width $W_{C1}$ along a distance $D_{C1}$; (2) maintains the width $W_{C1}$ along a distance $D_{C2}$, (3) tapers toward the longitudinal axis $A_C$ to a width $W_{C2}$ along a distance $D_{C3}$; and (4) maintains the width $W_{C2}$ along a distance $D_{C4}$.

Although not shown, the transverse cross-section of the driver blade 406 (taken along a horizontal plane perpendicular to the longitudinal axis $A_C$): (1) along the distance $D_{C2}$ is generally rectangular shaped, and its size and shape do not change; and (2) along the distance $D_{C4}$ is generally rectangular shaped, and its size and shape do not change. Put differently, the transverse cross-section of the driver blade 406 is generally uniform along the distance $D_{C2}$ and along the distance $D_{C4}$. The transverse cross-section of the driver blade 406 along the distance $D_{C2}$ and the transverse cross-section of the driver blade 406 along the distance $D_{C4}$ are different.

Since $D_{C2}$ is the same as $D_{A2}$, assuming all other factors are held constant, the pressure in the return chamber would be the same for the driving elements 200 and 400.

Figure 12:
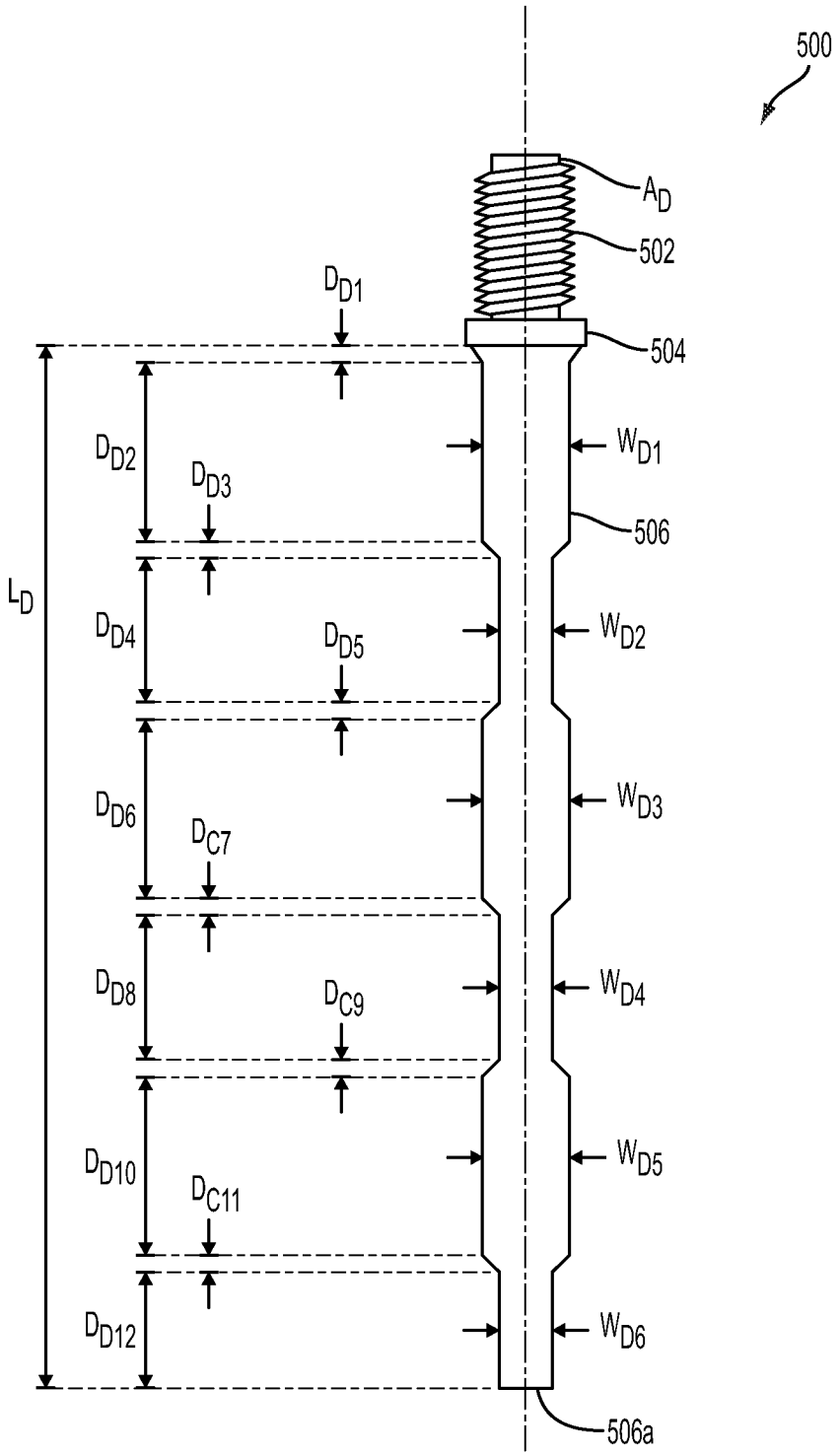
FIG. 12 is a front elevational view of another driving element with a varying cross-section.

FIG. 12 shows another example driving element 500, which includes: (1) an externally threaded connection element 502 threadably engageable to the piston 24; (2) a flange 504 attached to the bottom end of the connection element 502 and having an upper surface (not labeled) sized to engage the underside of the piston when the piston is threadably engaged to the connection element 502; and (3) a driver blade 506 attached to and extending from a lower surface (not labeled) of the flange 504 and terminating in a free end 506*a*.

The driver blade 506 has a longitudinal axis $A_D$ and a length $L_D$. Moving from the flange 504 to the free end 506*a* along the longitudinal axis $A_D$, the driver blade 5060: (1) tapers toward the longitudinal axis $A_D$ to a width $W_{D1}$ along a distance $D_{D1}$; (2) maintains the width $W_{D1}$ along a distance $D_{D2}$, (3) tapers toward the longitudinal axis $A_D$ to a width $W_{D2}$ along a distance $D_{D3}$; (4) maintains the width $W_{D2}$ along a distance $D_{D4}$; (5) tapers away from the longitudinal axis $A_D$ to a width $W_{D3}$ along a distance $D_{D5}$; (6) maintains the width $W_{D3}$ along a distance $D_{D6}$; (7) tapers toward the longitudinal axis $A_D$ to a width $W_{D4}$ along a distance $D_{D7}$; (8) maintains the width $W_{D4}$ along a distance $D_{D8}$, (9) tapers away from the longitudinal axis $A_D$ to a width $W_{D5}$ along a distance $D_{D9}$; (10) maintains the width $W_{D5}$ along a distance $D_{D10}$; (11) tapers toward the longitudinal axis $A_D$ to a width $W_{D6}$ along a distance $D_{D11}$; and (12) maintains the width $W_{D6}$ along a distance $D_{D12}$.

Although not shown, the transverse cross-section of the driver blade 506 (taken along a horizontal plane perpendicular to the longitudinal axis $A_D$): (1) along the distance $D_{D2}$ is generally rectangular shaped, and its size and shape do not change; (2) along the distance $D_{D4}$ is generally rectangular shaped, and its size and shape do not change; (3) along the distance $D_{D6}$ is generally rectangular shaped, and its size and shape do not change; (4) along the distance $D_{D8}$ is generally rectangular shaped, and its size and shape do not change; (5) along the distance $D_{D10}$ is generally rectangular shaped, and its size and shape do not change; and (6) along the distance $D_{D12}$ is generally rectangular shaped, and its size and shape do not change. Put differently, the transverse cross-section of the driver blade 506 is generally uniform along the distances $D_{D2}$, $D_{D4}$, $D_{D6}$, $D_{D8}$, $D_{D10}$, and $D_{D12}$. The transverse cross-sections of the driver blade 506 along the distances $D_{D2}$, $D_{D6}$, and $D_{D10}$ are different form the transverse cross-sections of the driver blade 506 along the distance distances $D_{D4}$, $D_{D8}$, and $D_{D12}$. The transverse cross-sections of the driver blade 506 along the distances $D_{D2}$, $D_{D6}$, and $D_{D10}$ may be the same or different. The transverse cross-sections of the driver blade 506 along the distances $D_{D4}$, $D_{D8}$, and $D_{D12}$ may be the same or different.

These are merely example driver blades with cross-sections that vary in terms of their width to ensure the unoccupied portion of the driver blade receiving opening changes during the fastener-driving cycle. The cross-section of the driver blade may vary in any suitable manner to ensure the unoccupied portion of the driver blade receiving opening changes during the fastener-driving cycle. For instance, in another embodiment the driver blade's width remains constant along its length but its thickness varies to ensure the unoccupied portion of the driver blade receiving opening changes during the fastener-driving cycle. In another embodiment the driver blade's width and thickness change along its length to ensure the unoccupied portion of the driver blade receiving opening changes during the fastener-driving cycle. In another embodiment the shape of the driver blade's transverse cross-section changes along its length to ensure the unoccupied portion of the driver blade receiving opening changes during the fastener-driving cycle.

While the above-described example tool is a combustion-powered-fastener-driving tool, the features described above can apply to other types of powered-fastener-driving tools, including tools powered pneumatically, electrically, or by powder cartridges.

It should be appreciated from the above that in various embodiments the present disclosure provides a fastener-driving tool comprising: a cylinder; a driver blade seal that defines a driver blade receiving opening; a driving element including a driver blade; and a piston within the cylinder and attached to the driving element such that the driver blade is slidably received in the driver blade receiving opening, wherein the piston is movable relative to the cylinder and the driver blade seal between: (1) a first position in which a first part of the driver blade occupies a first portion of the driver blade receiving opening; and (2) a second position in which a second part of the driver blade occupies a second portion of the driver blade receiving opening that is larger than the first portion.

In various such embodiments of the fastener-driving tool, the first position is a pre-firing position near an upper end of the cylinder and the second position is a firing position near a lower end of the cylinder.

In various such embodiments of the fastener-driving tool, an interior volume of the cylinder between the piston and the driver blade seal is in fluid communication with atmosphere at least in part via a portion of the driver blade receiving opening not occupied by the driver blade.

In various such embodiments of the fastener-driving tool, a first unoccupied portion of the driver blade receiving opening is not occupied by the driver blade when the driver blade is in the first position and a second unoccupied portion of the driver blade receiving opening that is smaller than the first unoccupied portion is not occupied by the driver blade when the driver blade is in the second position.

In various such embodiments of the fastener-driving tool, the first part of the driver blade has a first width and the second part of the driver blade has a second width that is larger than the first width.

In various such embodiments of the fastener-driving tool, the first part of the driver blade has a first thickness and the second part of the driver blade has a second thickness that is larger than the first thickness.

In various such embodiments of the fastener-driving tool, the cylinder defines one or more openings there through, and the fastener-driving tool further comprises a return chamber in fluid communication with the cylinder via the one or more openings.

In various such embodiments of the fastener-driving tool, the return chamber is in fluid communication with atmosphere at least in part via the one or more openings and via a portion of the driver blade receiving opening not occupied by the driver blade.

In various such embodiments, the fastener-driving tool further comprises one of: (1) an internal combustion engine assembly; and (2) an air inlet attachable to a compressed air source.

It should also be appreciated from the above that in various embodiments the present disclosure provides a fastener-driving tool comprising: a cylinder; a driver blade seal that defines a driver blade receiving opening; a driving element including a driver blade; and a piston within and movable relative to the cylinder and the driver blade seal and that is attached to the driving element such that the driver blade is slidably received in the driver blade receiving opening, wherein the driver blade has a non-uniform cross-section such that a portion of the driver blade receiving opening occupied by the driver blade changes as the piston moves relative to the cylinder from a first position to a second position.

In various such embodiments of the fastener-driving tool, a first part of the driver blade occupies a first portion of the driver blade receiving opening when the piston is in the first position and second part of the driver blade occupies a second portion of the driver blade receiving opening that is larger than the first portion when the piston is in the second position.

In various such embodiments of the fastener-driving tool, the first position is a pre-firing position near an upper end of the cylinder and the second position is a firing position near a lower end of the cylinder.

In various such embodiments of the fastener-driving tool, the first part of the driver blade has a first width and the second part of the driver blade has a second width that is larger than the first width.

In various such embodiments of the fastener-driving tool, the first part of the driver blade has a first thickness and the second part of the driver blade has a second thickness that is larger than the first thickness.

In various such embodiments of the fastener-driving tool, an interior volume of the cylinder between the piston and the driver blade seal is in fluid communication with atmosphere at least in part via a portion of the driver blade receiving opening not occupied by the driver blade.

In various such embodiments of the fastener-driving tool, a first unoccupied portion of the driver blade receiving opening is not occupied by the driver blade when the driver blade is in the first position and a second unoccupied portion of the driver blade receiving opening that is smaller than the first unoccupied portion is not occupied by the driver blade when the driver blade is in the second position.

In various such embodiments of the fastener-driving tool, the cylinder defines one or more openings there through, and the fastener-driving tool further comprises a return chamber in fluid communication with the cylinder via the one or more openings.

In various such embodiments of the fastener-driving tool, the return chamber is in fluid communication with atmosphere at least in part via the one or more openings and via a portion of the driver blade receiving opening not occupied by the driver blade.

In various such embodiments, the fastener-driving tool further comprises one of: (1) an internal combustion engine assembly; and (2) an air inlet attachable to a compressed air source.

Various changes and modifications to the above-described embodiments described herein will be apparent to those skilled in the art. These changes and modifications can be made without departing from the spirit and scope of this present subject matter and without diminishing its intended advantages. Not all of the depicted components described in this disclosure may be required, and some implementations may include additional, different, or fewer components from those expressly described in this disclosure. Variations in the arrangement and type of the components; the shapes, sizes, and materials of the components; and the manners of attachment and connections of the components may be made without departing from the spirit or scope of the claims as set forth herein. Also, unless otherwise indicated, any directions referred to herein reflect the orientations of the components shown in the corresponding drawings and do not limit the scope of the present disclosure. This specification is intended to be taken as a whole and interpreted in accordance with the principles of the invention as taught herein and understood by one of ordinary skill in the art.

The invention claimed is:

1. A fastener-driving tool comprising:

a cylinder;

a driver blade seal that defines a driver blade receiving opening;

a driving element including a driver blade, the driver blade having a first part with a first cross-section and a second part having a second cross-section that is larger than the first cross-section; and a piston within the cylinder and attached to the driving element such that the driver blade is slidably received in the driver blade receiving opening, wherein the piston is movable relative to the cylinder and the driver blade seal between: (1) a first position in which the first part of the driver blade occupies a first portion of the driver blade receiving opening; and (2) a second position in which the second part of the driver blade occupies a second portion of the driver blade receiving opening that is larger than the first portion, and wherein an interior volume of the cylinder between the piston and the driver blade seal is in fluid communication with atmosphere at least in part via a portions of the driver blade receiving opening not occupied by the driver blade, wherein when the piston is in the first position, the driver blade allows a first amount of air to flow through the portions of the driver blade receiving opening not occupied by the driver blade, wherein when the piston is in the second position, the driver blade allows a second amount of air to flow through the portions of the driver blade receiver opening not occupied by the driver blade, and wherein the first amount of air is greater than the second amount of air.

2. The fastener-driving tool of claim 1, wherein the first position is a pre-firing position near an upper end of the cylinder and the second position is a firing position near a lower end of the cylinder.

3. The fastener-driving tool of claim 1, wherein the first part of the driver blade has a first width and the second part of the driver blade has a second width that is larger than the first width.

4. The fastener-driving tool of claim 1, wherein the first part of the driver blade has a first thickness and the second part of the driver blade has a second thickness that is larger than the first thickness.

5. The fastener-driving tool of claim 1, wherein the cylinder defines one or more openings therethrough, and further comprising a return chamber in fluid communication with the cylinder via the one or more openings.

6. The fastener-driving tool of claim 5, wherein the return chamber is in fluid communication with atmosphere at least in part via the one or more openings and via a portion of the driver blade receiving opening not occupied by the driver blade.

7. The fastener-driving tool of claim 1, further comprising one of: (1) an internal combustion engine assembly; and (2) an air inlet attachable to a compressed air source.

8. The fastener-driving tool of claim 1, wherein the second amount of air allowed to flow through the portions of the driver blade receiving opening not occupied by the driver blade is zero.

9. A fastener-driving tool comprising:

a cylinder;

a driver blade seal that defines a driver blade receiving opening;

a driving element including a driver blade, the driver blade having a first part with a first cross-section and a second part having a second cross-section that is larger than the first cross-section; and a piston within and movable relative to the cylinder and the driver blade seal and that is attached to the driving element such that the driver blade is slidably received in the driver blade receiving opening, wherein the first part of the driver blade with the first cross-section and the second part of the driver blade with the second cross-section are configured to occupy different portions of the driver blade receiving opening, wherein the portions of the driver blade receiving opening occupied by the driver blade changes as the piston moves relative to the cylinder from a first position in which the first part of the driver blade is in the driver blade receiving opening to a second position in which the second part of the driver blade is in the driver blade receiving opening, wherein an interior volume of the cylinder between the piston and the driver blade seal is in fluid communication with atmosphere at least in part via portions of the driver blade receiving opening not occupied by the driver blade, wherein when the first part of the driver blade is in the driver blade receiving opening, the driver blade allows a first amount of air to flow through the portions of the driver blade receiving opening not occupied by the driver blade, wherein when the second part of the driver blade is in the driver blade receiving opening, the driver blade allows a second amount of air to flow through the portions of the driver blade receiver opening not occupied by the driver blade, and wherein the first amount of air is greater than the second amount of air.

10. The fastener-driving tool of claim 9, wherein a first part of the driver blade occupies a first portion of the driver blade receiving opening when the piston is in the first position and second part of the driver blade occupies a second portion of the driver blade receiving opening that is larger than the first portion when the piston is in the second position.

11. The fastener-driving tool of claim 10, wherein the first position is a pre-firing position near an upper end of the cylinder and the second position is a firing position near a lower end of the cylinder.

12. The fastener-driving tool of claim 10, wherein the first part of the driver blade has a first width and the second part of the driver blade has a second width that is larger than the first width.

13. The fastener-driving tool of claim 10, wherein the first part of the driver blade has a first thickness and the second part of the driver blade has a second thickness that is larger than the first thickness.

14. The fastener-driving tool of claim 9, wherein the cylinder defines one or more openings therethrough, and further comprising a return chamber in fluid communication with the cylinder via the one or more openings.

15. The fastener-driving tool of claim 14, wherein the return chamber is in fluid communication with atmosphere at least in part via the one or more openings and via a portion of the driver blade receiving opening not occupied by the driver blade.

16. The fastener-driving tool of claim 9, further comprising one of: (1) an internal combustion engine assembly; and (2) an air inlet attachable to a compressed air source.

17. The fastener-driving tool of claim 9, wherein the second amount of air allowed to flow through the portions of the driver blade receiving opening not occupied by the driver blade is zero.

* * * * *